US007070510B2

(12) United States Patent
Heddon

(10) Patent No.: US 7,070,510 B2
(45) Date of Patent: Jul. 4, 2006

(54) BOWLING ALLEY BUMPER SYSTEM

(76) Inventor: Will Heddon, 302 E. Central Ave., Lake Wales, FL (US) 33853

( * ) Notice: Subject to any disclaimer, the term of this patent is extended or adjusted under 35 U.S.C. 154(b) by 0 days.

(21) Appl. No.: 10/919,753

(22) Filed: Aug. 17, 2004

(65) Prior Publication Data

US 2006/0040754 A1 Feb. 23, 2006

(51) Int. Cl.
*A63D 5/00* (2006.01)

(52) U.S. Cl. ..... 473/55; 473/113

(58) Field of Classification Search ..... 473/54, 473/55, 106, 113, 115
See application file for complete search history.

(56) References Cited

U.S. PATENT DOCUMENTS 5,417,616 A * 5/1995 Widrick ..... 473/113
RE35,232 E * 5/1996 Stephens ..... 473/55
5,857,918 A * 1/1999 Beene ..... 473/55
6,402,629 B1 * 6/2002 Heddon ..... 473/55

* cited by examiner

*Primary Examiner*—William M. Pierce
(74) *Attorney, Agent, or Firm*—Arthur W. Fisher, III

(57) ABSTRACT

A bowling alley bumper system including a pair of retractable bumper assemblies for use with a bowling lane to prevent bowling balls from entering either gutter when the retractable bumper assemblies are deployed, each retractable bumper assembly comprises an elongated retractable rail selectively movable between a retracted position and a deployed position disposed between one side of the bowling lane and the corresponding gutter such that when either elongated retractable rail is in the retracted position a bowling ball can enter the corresponding gutter and when either elongated retractable rail is in the deployed position a bowling ball is prevented from entering the corresponding gutter.

8 Claims, 6 Drawing Sheets

BOWLING ALLEY BUMPER SYSTEM

BACKGROUND OF THE INVENTION

1. Field of the Invention

A retractable bowling alley bumper system for use with a bowling lane to selectively prevent bowling balls from entering either gutter.

2. Description of the Prior Art

A poorly thrown bowling ball can fall into either gutter. For various reasons bumper systems have been developed that prevent a bowling ball from entering the gutters. Generally, an elongated guard or rail is placed along the length of each gutter to prevent a bowling ball from entering the corresponding gutter.

Numerous retractable bumper systems have been developed which permit the elongated guards or rails to be easily deployed or retracted. There are several problems associated with these various systems including:

- The attaching means at the pivot connection between the rail and the support members normally consist of a mechanical fastener that is exposed to view.
- The pivots are rigidly mechanically attached to the rail making the pivots vulnerable to ball impact, which in turn causes damage to the pivots.
- Some rail materials expand and contract with moisture and/or temperature changes. This causes undo stress on the rails and pivot arms.
- Assembly is required on all the known rail pivot combinations prior to packaging and shipping which adds to the cost of shipping, labor and overhead.
- Exposed fasteners sometimes come loose and cause ball damage.
- Excessive ball speed impact damages rails and pivot arms that must be replaced prior additional use. Replacement is time consuming and expensive and normally involves both the rail and multiple pivot arms.

U.S. Pat. No. 6,402,629 describes a bumper system to prevent a bowling ball from entering the gutters, redirecting the ball into the lane comprising a longitudinal rail with a plurality of pivot arms affixed thereto. The pivot arms are pivotally affixed to the lane bed such that when the bumper system is in a retracted position the horizontal surface of the longitudinal rails are in a substantially abutting relation to the side of the lane, and the adjacent gutters are adapted to receive any balls that are bowled towards either side of the lane, directing the balls to the end of the lane, missing the pin deck. In an extended position, the longitudinal rails prevent balls from entering the adjacent gutters redirecting balls into the lane such that the balls strike the pins in the pin deck.

U.S. Pat. No. 5,380,251 discloses a bowling alley bumper system to selectively guard against a bowling ball rolling into a gutter comprising a bungee cord extends along each side edge of a bowling alley lane. When the bungee cord is and in a first position below the lane surface bowling balls can roll into a gutter. A lifting mechanism can raise the bungee cord to a position above the lane surface for receiving bowling balls rolling on the surface toward the gutter and redirecting the bowling balls toward the center of the lane and away from the gutter. The bungee cord is lifted to its second position by a plurality of elongated rods positioned to move alongside the lane below the gutter surface. A connecting rod raises and lowers the elongated rods through a lever action thereby positioning the bungee cord at its first stored position or its elevated position for guarding the gutter.

Additional examples of such retractable bumper systems have been described in: U.S. Pat. Nos. 4,420,155; 4,792,136; 4,900,024; 5,181,716; 5,207,422; 5,304,097; 5,322,476; 5,358,448; 45,405,295; 5,415,591; 5,417,616; 5,435,788; U.S. Pat. No. RE. 35,232; U.S. Pat. Nos. 5,564,986; 5,681,224; 5,800,274 and 5,857,918.

SUMMARY OF THE INVENTION

The present invention relates to a bowling alley bumper system for use with a bowling lane to prevent a bowling ball from entering either gutter. The bowling alley bumper system comprises a retractable bumper assembly disposed on each side of the bowling lane.

Each retractable bumper assembly comprises a retractable rail and a corresponding plurality of rail support members selectively movable between a retracted position and a deployed position.

A channel having a slot on each side thereof is formed on the retracted rail to operatively receive the upper portion of each rail support member of the corresponding plurality of rail support members and a corresponding protrusion extending from each side of the corresponding rail support member. The upper portion and corresponding protrusions are free to slide within the channel and corresponding retractable bumper assembly is moved between the retracted position and the deployed position.

Each retractable bumper assembly can be displaced or moved between the retracted position and the deployed position by mechanical, electrical or pneumatic displacement systems, and will be readily apparent to the skilled artisan.

The invention accordingly comprises the features of construction, combination of elements, and arrangement of parts that will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
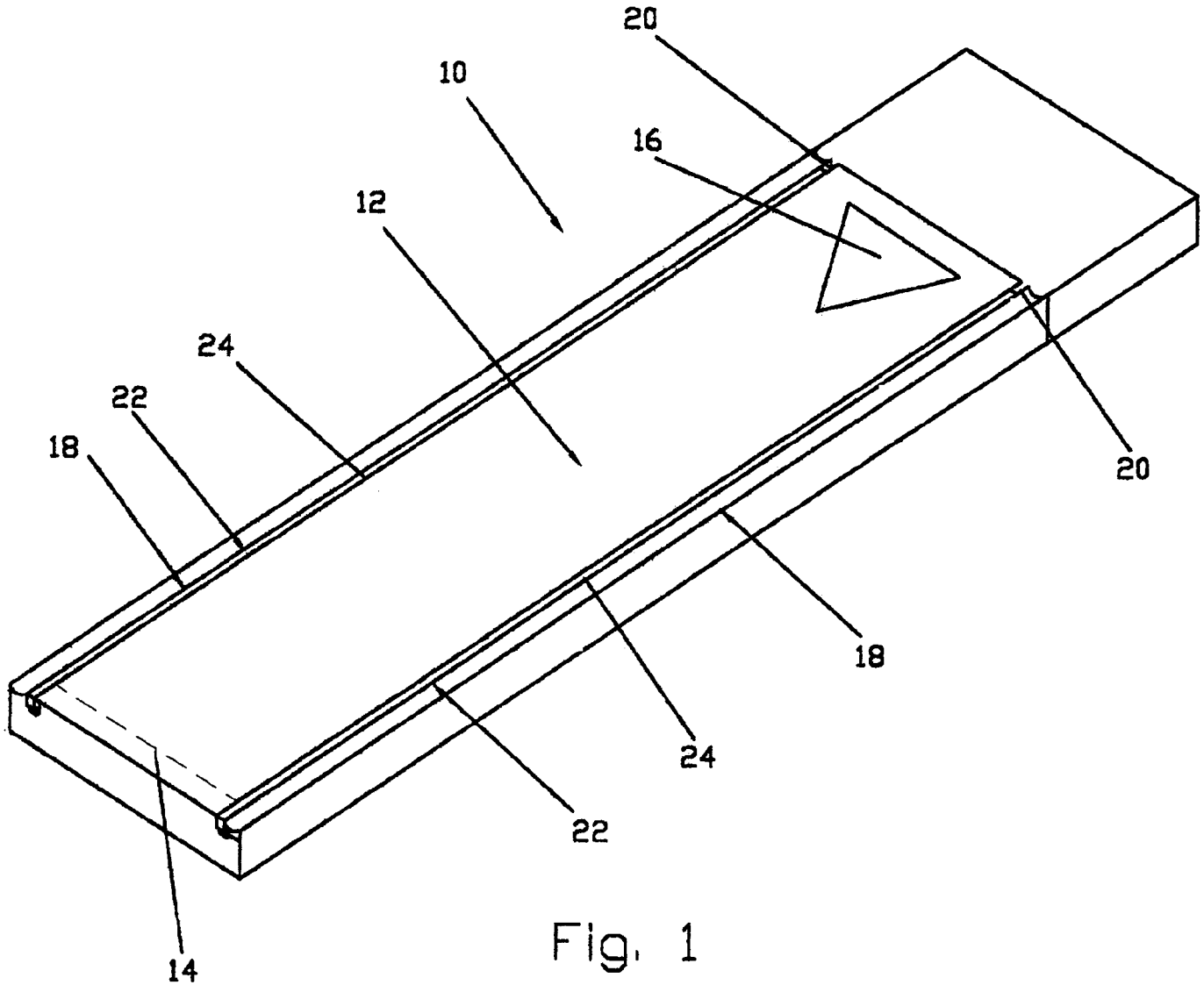
FIG. 1 is a perspective view of the bowling alley bumper assemblies of the present invention with the retractable bumper assemblies in the retracted position.

The present invention relates to a bowling alley bumper system for use with a bowling lane generally indicated as 10 including an elongated bowling lane surface 12 having a foul line 14 and pin spotting area 16 on opposite end portions thereof and an elongated gutter 18 disposed on each side 20 of the bowling lane surface 12. The bowling alley bumper system comprises a retractable bumper assembly generally indicated as 22 disposed on each side 20 of the bowling lane surface 12 between the corresponding side 20 and the corresponding elongated gutter 18.

Figure 2:
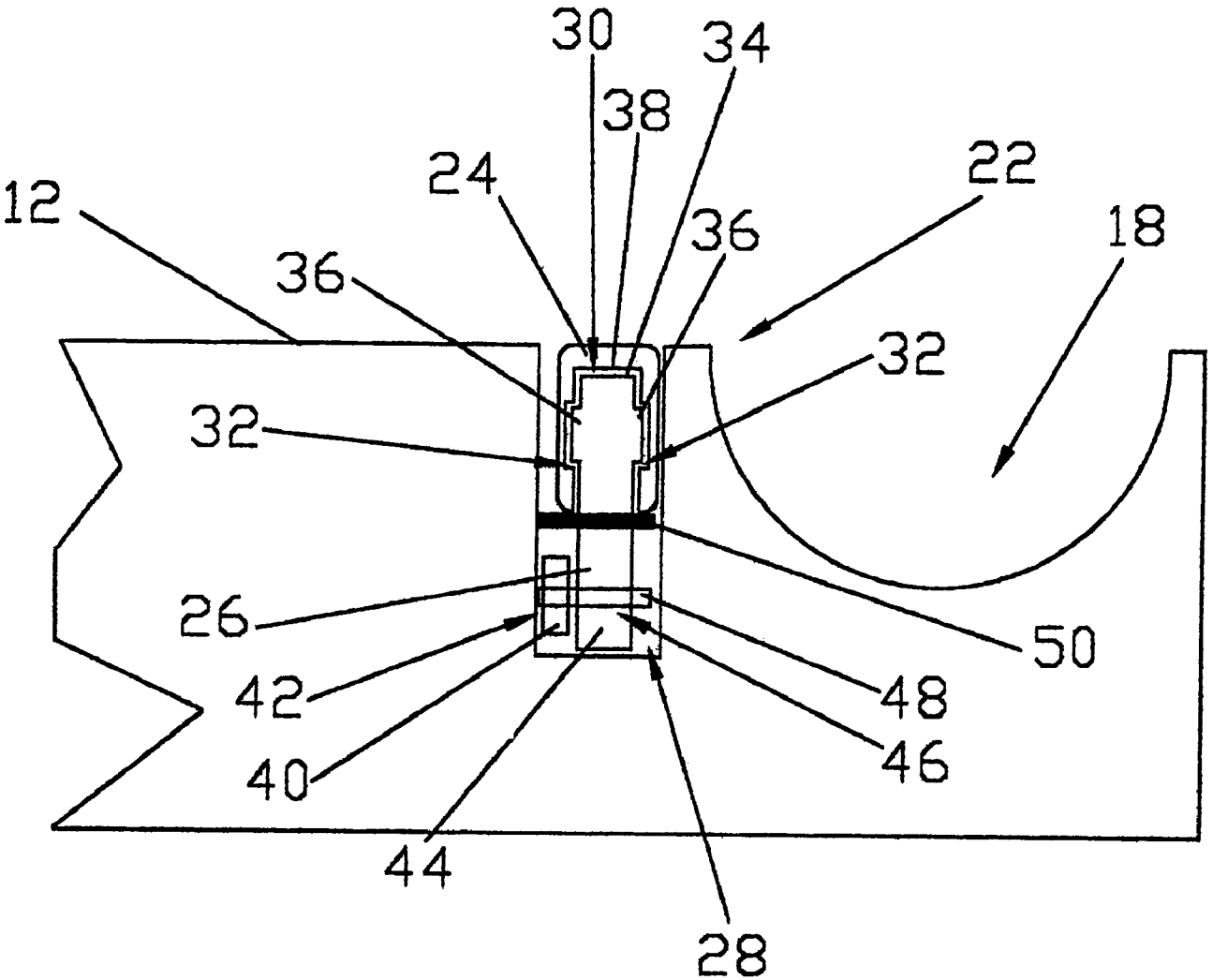
FIG. 2 is an end view of the bowling alley bumper assemblies of the present invention with the retractable bumper assemblies in the retracted position.
Figure 3:
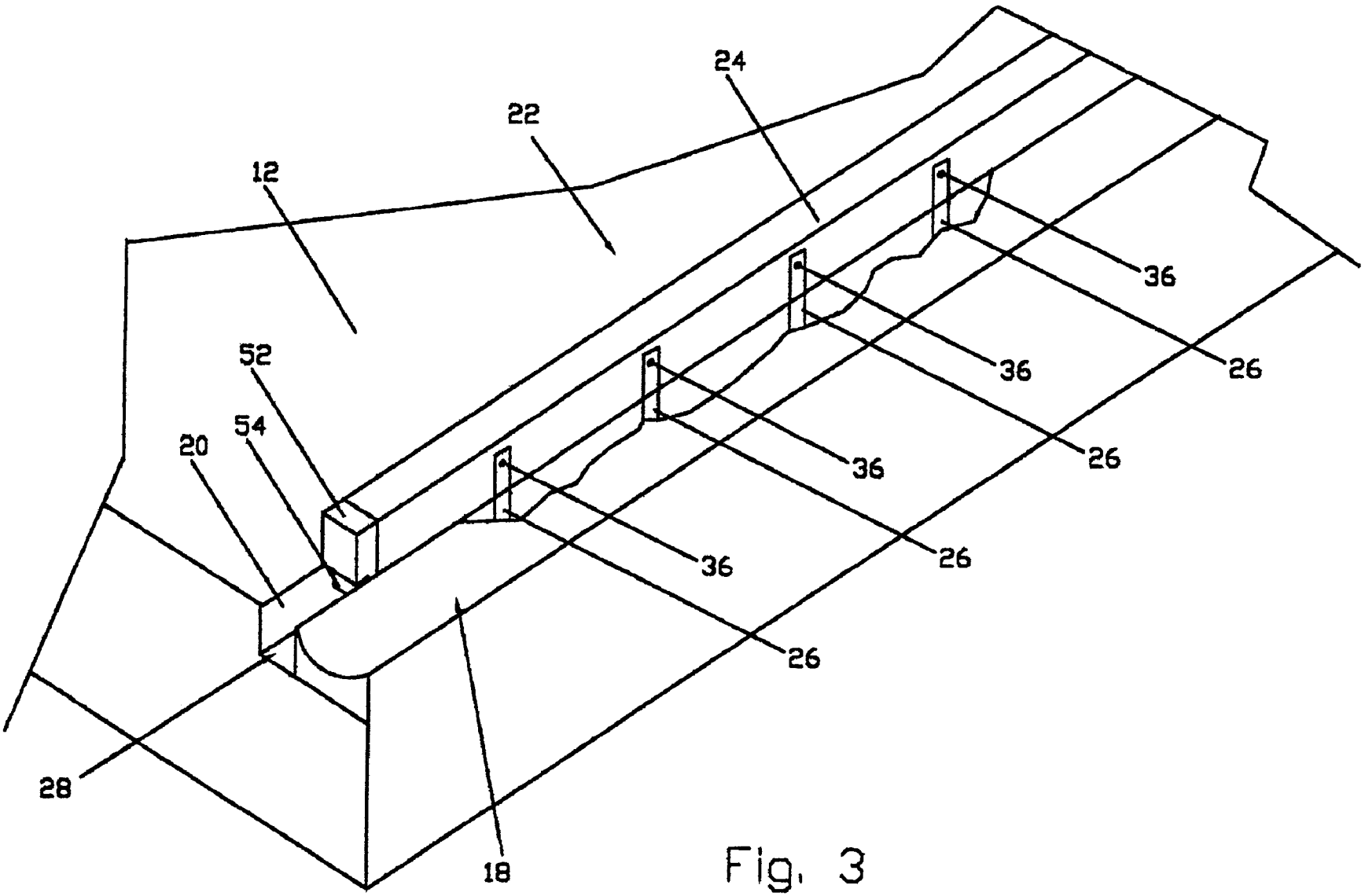
FIG. 3 is a perspective view of the bowling alley bumper assemblies of the present invention with the retractable bumper assemblies in the deployed position.
Figure 4:
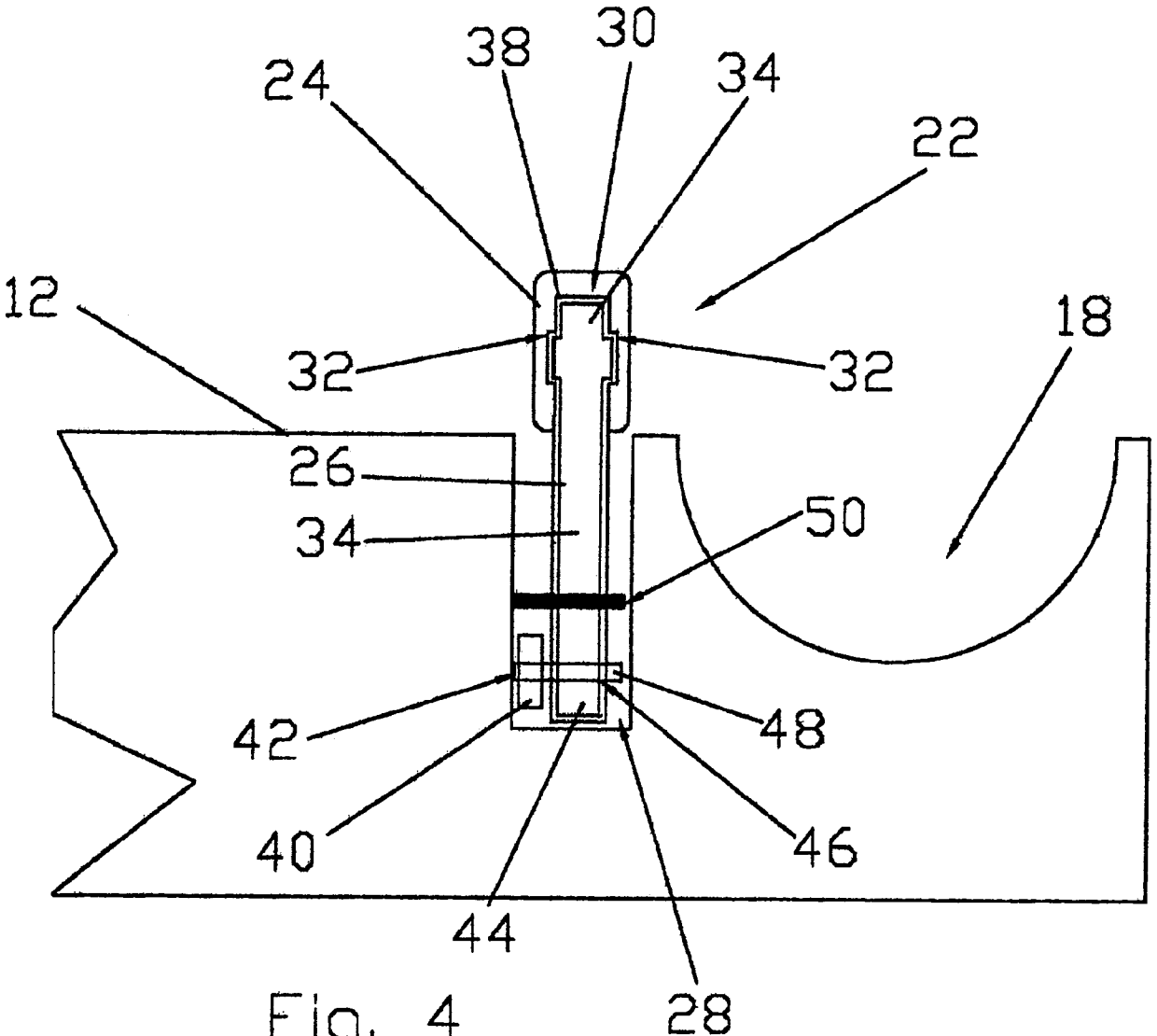
FIG. 4 is an end view of the bowling alley bumper assemblies of the present invention with the retractable bumper assemblies in the deployed position.

Each retractable bumper assembly 22 comprises an elongated retractable rail 24 and a corresponding plurality of rail support members each indicated as 26 selectively movable between a retracted position as shown in FIGS. 1 and 2, and a deployed position as shown in FIGS. 3 and 4 at least partially disposed within a space or slot 28 between each side 20 of the bowling lane surface 12 and the corresponding gutter 18.

Figure 5:
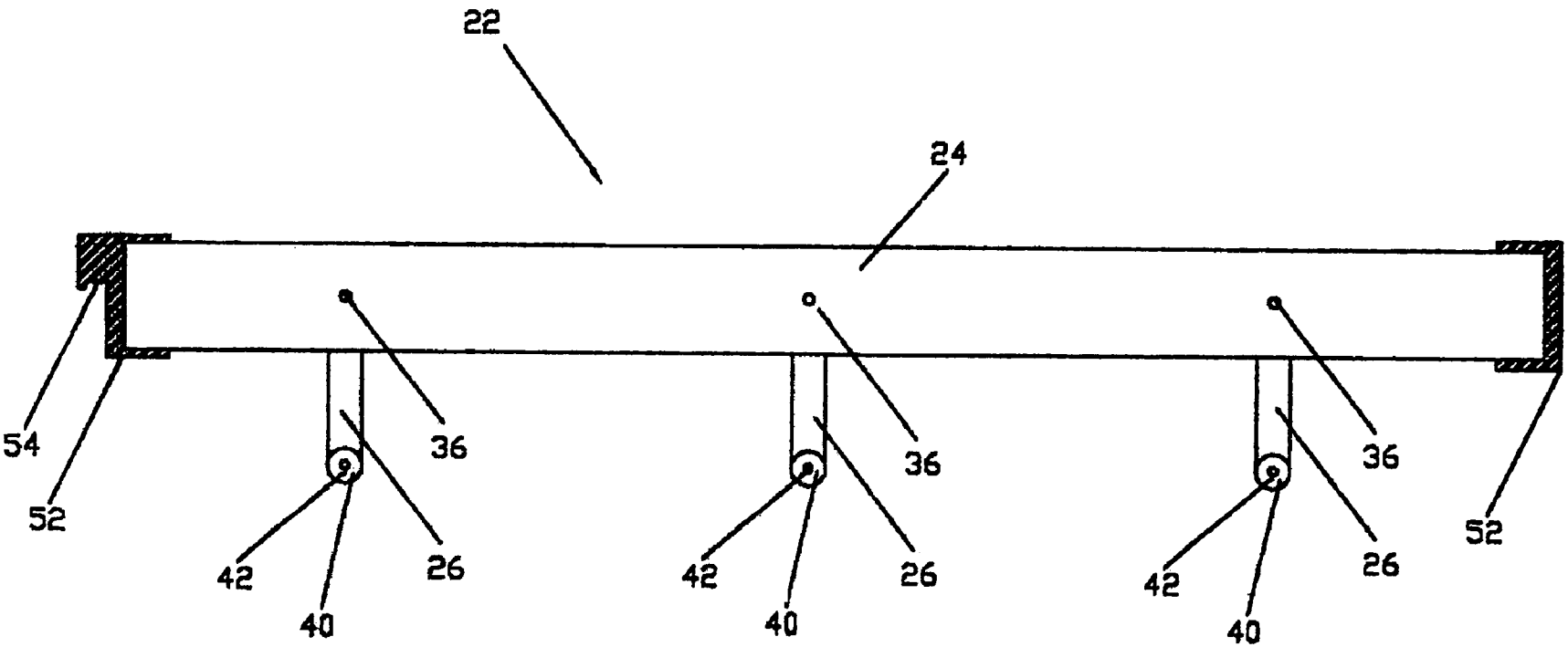
FIG. 5 is an exploded side view of a retractable bumper assembly of the present invention.
Figure 6:
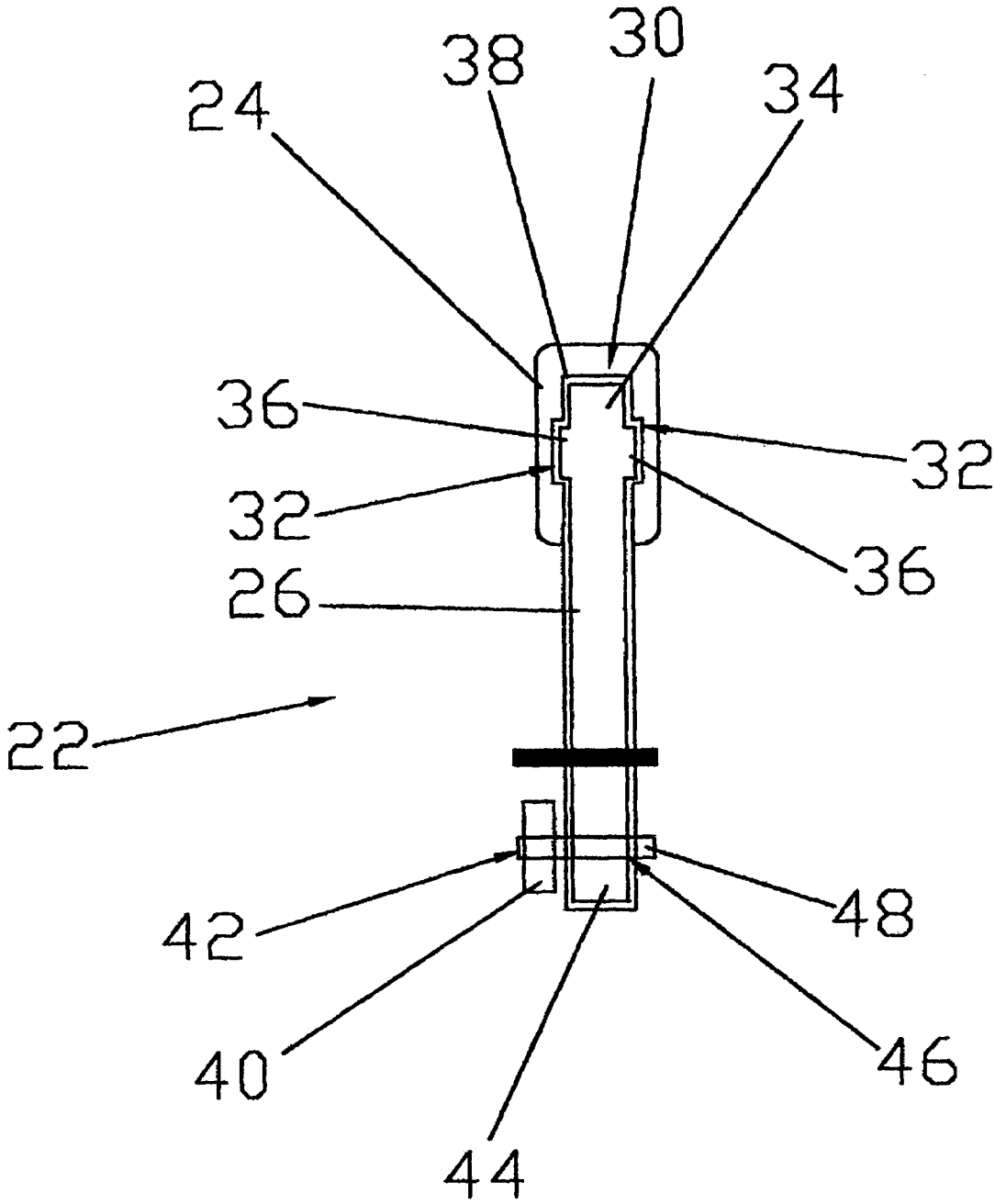
FIG. 6 is an exploded end view of a retractable bumper assembly of the present invention.

As best shown in FIGS. 5 and 6, an elongated channel 30 having a keyway or slot 32 on each side there is formed on the lower portion of corresponding elongated retractable rail 24 to operatively receive the upper portion 34 of each rail support member 26 of the corresponding plurality of rail support members and a corresponding key or protrusion 36 extending from each side of the corresponding rail support member 26 in spaced relation relative to the upper tip or end 38 thereof respectively. Since the upper portion 34 of each support member 26 and corresponding keys or protrusions 36 are not connected or coupled to the corresponding elongated rail 24, the upper portion 34 and corresponding keys or protrusions 36 are free to slide within the elongated channel 30 and corresponding keyways or slots 32 as the corresponding retractable bumper assembly 22 is moved between the retracted position and the deployed position. A spacer or bushing 40 having a channel or aperture 42 formed therethrough is formed or mounted on the lower portion 44 of the corresponding rail support member 26 in concentric alignment with an aperture 46 to receive a mounting member or pin 48 therethrough to pivotally mount each rail mounting member 26 to the corresponding side 26 of the bowling lane surface 12.

Each retractable bumper assembly 22 further includes at least one limit or stop 50 disposed to engage at least one of the rail support members 26 when the corresponding retractable bumper assembly 22 is moved to the deployed position to maintain the corresponding retractable bumper assembly 22 in the deployed position wherein the elongated rail 24 is disposed above the bowling lane surface 24 to engage a bowling ball approaching the corresponding gutter 18 to prevent the bowling ball from traveling from the bowling lane surface 12 into the gutter. As shown, the limit or stop 50 is attached to each side 24. Of course, the limit or stop 50 can be attached or coupled to each elongated gutter 18 or other portion of the bowling lane 10. The limit or stop 50 is preferably positioned to engage the rail support member 26 when the longitudinal centerline of the rail support member 26 rotates through vertical as the retractable bumper assembly 22 moves between the first and retracted position and the deployed position.

Each retractable bumper assembly 22 can be displaced or moved between the first and retracted position and the deployed position by mechanical, electrical or pneumatic displacement systems, and will be readily apparent to the skilled artisan.

A cap or end piece 52 can be placed on opposite end portions of each elongated retractable rail 24. The proximal cap or end piece 52 may include a hand hold 54 to grasp and position the corresponding retractable bumper assembly 22.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A bowling alley bumper system including at least one retractable bumper assembly for use with a bowling lane to selectively prevent bowling balls from entering a gutter adjacent said retractable bumper assembly when said retractable bumper assembly is deployed, said retractable bumper assembly comprises an elongated retractable rail and a plurality of rail support members selectively movable between a retracted position and a deployed position disposed between one side of the bowling lane and the gutter disposed adjacent thereto such that when said elongated retractable rail is in said retracted position bowling balls can enter the gutter and when said elongated retractable rail is in said deployed position bowling balls are prevented from entering the gutter each said rail support member is pivotally disposed adjacent to the gutter to be selectively movable between said retracted position and said deployed position, said elongated retractable rail includes an elongated channel formed in the lower portion thereof having an interior channel wall on each side thereof, each said channel wall includes an elongated slot formed therein and each said rail support member includes a protrusion extending from each side thereof disposed within a corresponding elongated slot formed in said corresponding channel wall such that each said protrusion slides within said corresponding elongated slot as said retractable bumper assembly is moved between said retracted position and said deployed position.

2. The bowling alley bumper system of claim 1 wherein said retractable bumper assembly further includes at least one limit disposed to engage at least one of said rail support members when said retractable bumper assembly is moved to said deployed position to maintain said retractable bumper assembly in said deployed position wherein said elongated rail is disposed above the bowling lane to engage a bowling ball approaching the corresponding elongated gutter to prevent the bowling ball from traveling from the bowling lane surface into the gutter.

3. The bowling alley bumper system of claim 2 wherein said limit is positioned to engage said rail support member when the longitudinal centerline of said rail support member rotates through vertical as said retractable bumper assembly moves from said retracted position to said deployed position.

4. The bowling alley bumper system of claim 1 wherein a spacer having a channel formed therethrough is formed on the lower portion each said rail support member in concentric alignment with an aperture formed through said rail support member to receive a mounting member or pin therethrough to pivotally mount each rail mounting member to the corresponding side of the bowling lane.

5. The bowling alley bumper system of claim 4 wherein said elongated rail includes an elongated channel having a slot formed on each side thereof to operatively receive a portion of each said rail support member of the corresponding plurality of rail support members and a corresponding protrusion extending from each side of said corresponding rail support member.

6. The bowling alley bumper system of claim 5 wherein said portion of each rail support member and corresponding protrusions are not coupled to said corresponding elongated rail such that said portion of each rail support member and said corresponding protrusions are free to slide within said elongated channel and corresponding slots as said retractable bumper assembly is moved between said retracted position and said deployed position.

7. The bowling alley bumper system of claim 6 wherein said retractable bumper assembly further includes at least one limit disposed to engage at least one of said rail support members when said retractable bumper assembly is moved to said deployed position to maintain said retractable bumper assembly in said deployed position wherein said elongated rail is disposed above the bowling lane to engage a bowling ball approaching the corresponding elongated gutter to prevent the bowling ball from traveling from the bowling lane surface into the gutter.

8. The bowling alley bumper system of claim 7 wherein said limit is positioned to engage said rail support member when the longitudinal centerline of said rail support member rotates through vertical as said retractable bumper assembly moves from said retracted position to said deployed position.

* * * * *